US007306028B2

(12) United States Patent
Zuo et al.

(10) Patent No.: US 7,306,028 B2
(45) Date of Patent: Dec. 11, 2007

(54) MODULAR HEAT SINK

(75) Inventors: Jon Zuo, Lancaster, PA (US); Ernest H. Dubble, Lancaster, PA (US); Donald M. Ernst, Lancaster, PA (US)

(73) Assignee: Thermal Corp., Wilmington, DE (US)

( * ) Notice: Subject to any disclaimer, the term of this patent is extended or adjusted under 35 U.S.C. 154(b) by 20 days.

(21) Appl. No.: 11/159,485

(22) Filed: Jun. 23, 2005

(65) Prior Publication Data

US 2006/0289147 A1 Dec. 28, 2006

(51) Int. Cl.
*F28D 15/04* (2006.01)

(52) U.S. Cl. ..... 165/104.26; 165/104.21

(58) Field of Classification Search ..... 165/104.14, 165/104.21, 104.26, 104.33
See application file for complete search history.

(56) References Cited

U.S. PATENT DOCUMENTS 5,689,881 A 11/1997 Kato
5,771,964 A 6/1998 Bae
5,865,243 A 2/1999 Kato et al.
6,005,772 A * 12/1999 Terao et al. ..... 165/80.4
6,076,596 A * 6/2000 Osakabe et al. ..... 165/104.33
6,321,831 B1 * 11/2001 Tanaka et al. ..... 165/104.33
6,325,141 B2 12/2001 Yamauchi et al.
6,347,662 B1 * 2/2002 Davidian et al. ..... 165/166
2003/0168207 A1 * 9/2003 Wang ..... 165/104.26
2005/0183846 A1 * 8/2005 Mok ..... 165/104.33

* cited by examiner

*Primary Examiner*—Teresa J. Walberg
(74) *Attorney, Agent, or Firm*—Michael Best & Friedrich LLP

(57) ABSTRACT

A modular based heat sink which can be easily optimized for a given heat source relies upon both phase change based heat transfer and condenser modules that combine the efficiency of folded fin cooling and the efficiency of the two phase heat transfer.

20 Claims, 8 Drawing Sheets

MODULAR HEAT SINK

FIELD OF THE INVENTION

The present invention generally relates to heat sinks for use in electronics, and more particularly to phase change based heat sinks.

BACKGROUND OF THE INVENTION

Single phase heat exchangers, such as "parallel flow" heat exchangers having multiple fluid conduits are described in U.S. Pat. No. 5,771,964. In such parallel flow heat exchangers, each tube is divided into a plurality of parallel flow paths of relatively small hydraulic diameter (e.g., 0.070 inch or less), which are often referred to as "microchannels", to accommodate the flow of heat transfer fluid. Parallel flow heat exchangers may be of the "tube and fin" type in which flat tubes are laced through a plurality of heat transfer enhancing fins or of the "folded fin" type in which folded fins are coupled between the flat tubes. These types of heat exchangers have been used as cooling condensers in applications where space is at a premium. U.S. Pat. Nos. 6,347,662; 6,325,141; 5,865,243; and 5,689,881 further describe such heat exchangers having multiple conduits that serve as condensers.

The prior art associated with the cooling of computer chips and electronic components has utilized heat sinks of several basic types. Metal extrusions such as aluminum heat sinks have been used since the early days of computers when power densities were relatively low. These well known heat sinks have the disadvantage of low thermal performance (slow heat transfer), particularly when applied to systems operating at the high power density conditions of today's electronic devices and systems.

A second type of thermal management structure includes metal extrusions in combination with bases made formed from high thermal conductivity materials, such as copper or engineered materials or, even flat heat pipes. While addressing the heat spreading problem of metal extrusions, this type of heat sink still relies, in part, upon heat conduction through extended fins to external surfaces. Current extrusion techniques do not easily produce fins at the pitch and height required for high performance applications.

A third type of thermal management structure is a tower heat sink. Tower heat sinks often have a high conductivity core that is made of solid metal or heat pipes. Plate fins or machined structures surround the core to provide extended heat transfer surfaces. Heat is transferred upward through the core, then across the extended surfaces to be dissipated to the ambient environment. Assembly of plate fins to the core often requires manual labor which is expensive and sometimes yields inconsistent quality.

As a consequence, there continues to be a need for an improved heat sink for cooling electronic devices that satisfactorily meet today's high power density requirements while providing manufacturing flexibility.

SUMMARY OF THE INVENTION

The present invention provides a modular heat sink that has a modular construction comprising a heat sink module and one or more condenser modules. In one preferred embodiment, a modular heat sink is provided including an evaporator chamber defined between a base and a first plate. The base has a wick disposed on an interior facing surface so as to be located within the evaporator chamber. The wick is spaced away from an interior facing surface of the first plate, and is at times saturated with a two-phase vaporizable fluid. The first plate defines a pair of spaced apart openings that communicate with the evaporator chamber. A pair of conduits, one positioned within each of the first plate openings, each have a passageway arranged in fluid flow communication with the evaporator chamber. A condenser chamber is defined between a second plate and a third plate. The second plate defines a pair of spaced apart second openings that communicate with a respective one of the conduits so as to allow for cyclic fluid flow communication between the evaporator chamber and the condenser chamber. The third plate is disposed in spaced apart confronting relation to the second plate. Advantageously, the first plate and the second plate are spaced apart from one another so as to form a void between them and between the pair of conduits so that a folded fin may be positioned within the void to improve heat transfer. A plurality of modules may be stacked together, as needed, to provide improved heat transfer.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
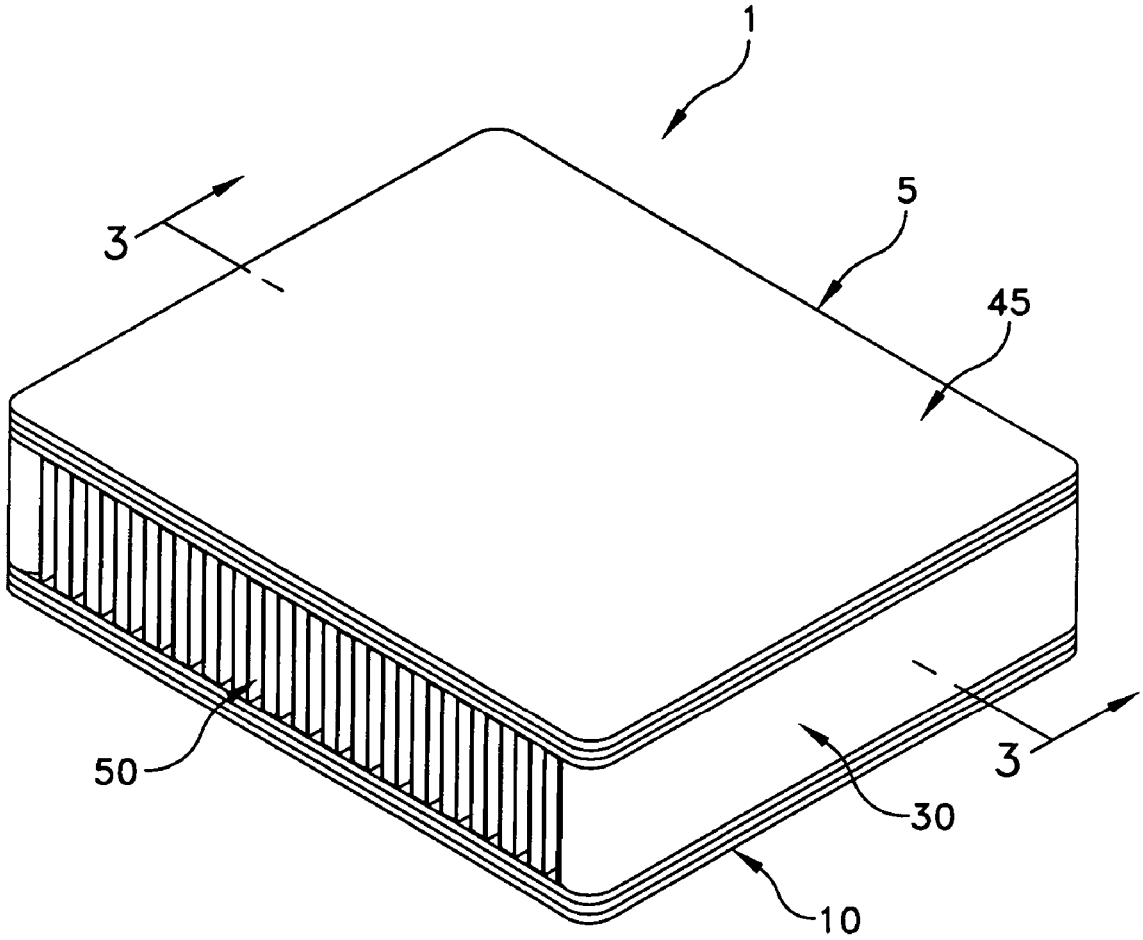
FIG. 1 is a perspective view of a modular heat sink formed in accordance with one embodiment of the invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Figure 2:
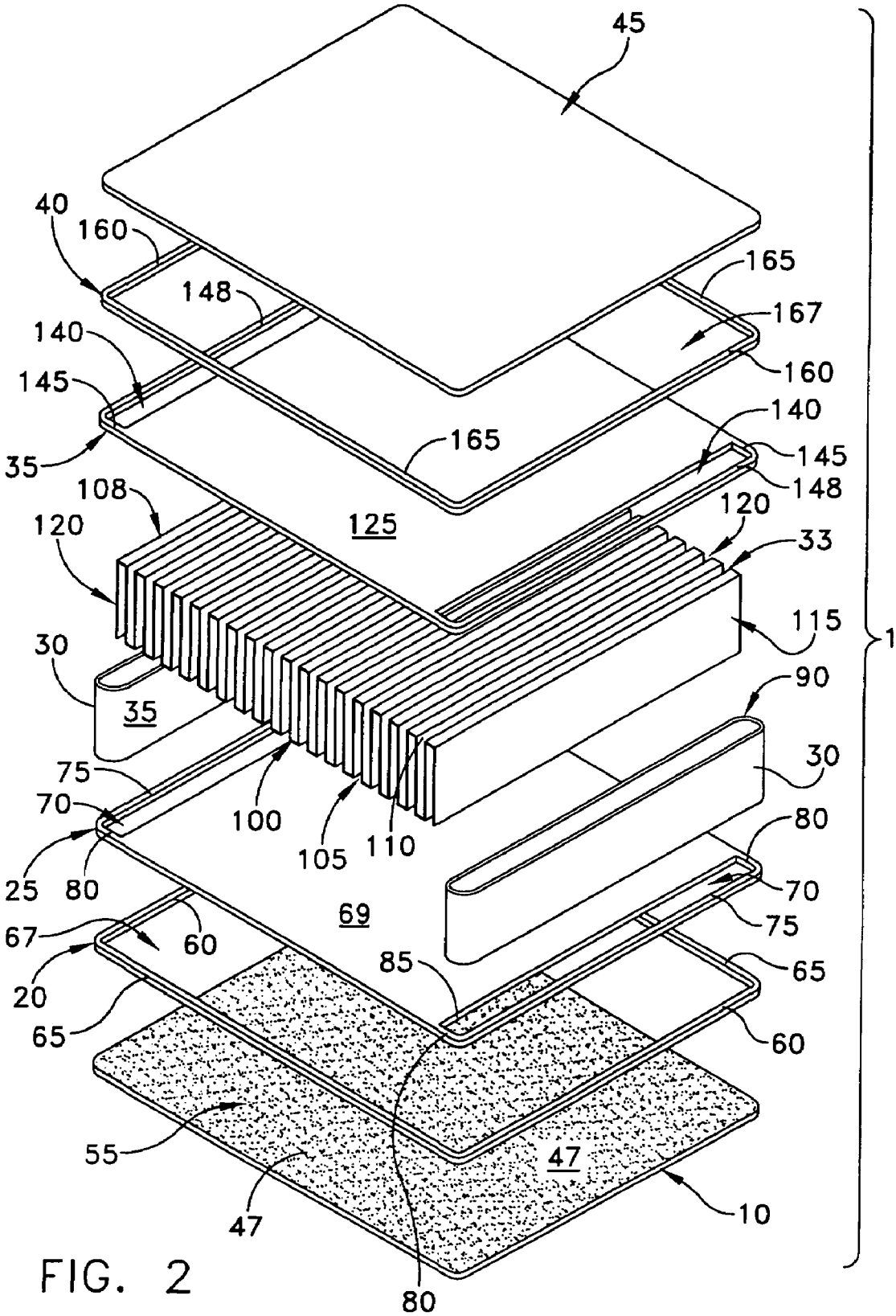
FIG. 2 is an exploded perspective view of the modular heat sink shown in FIG. 1.
Figure 3:
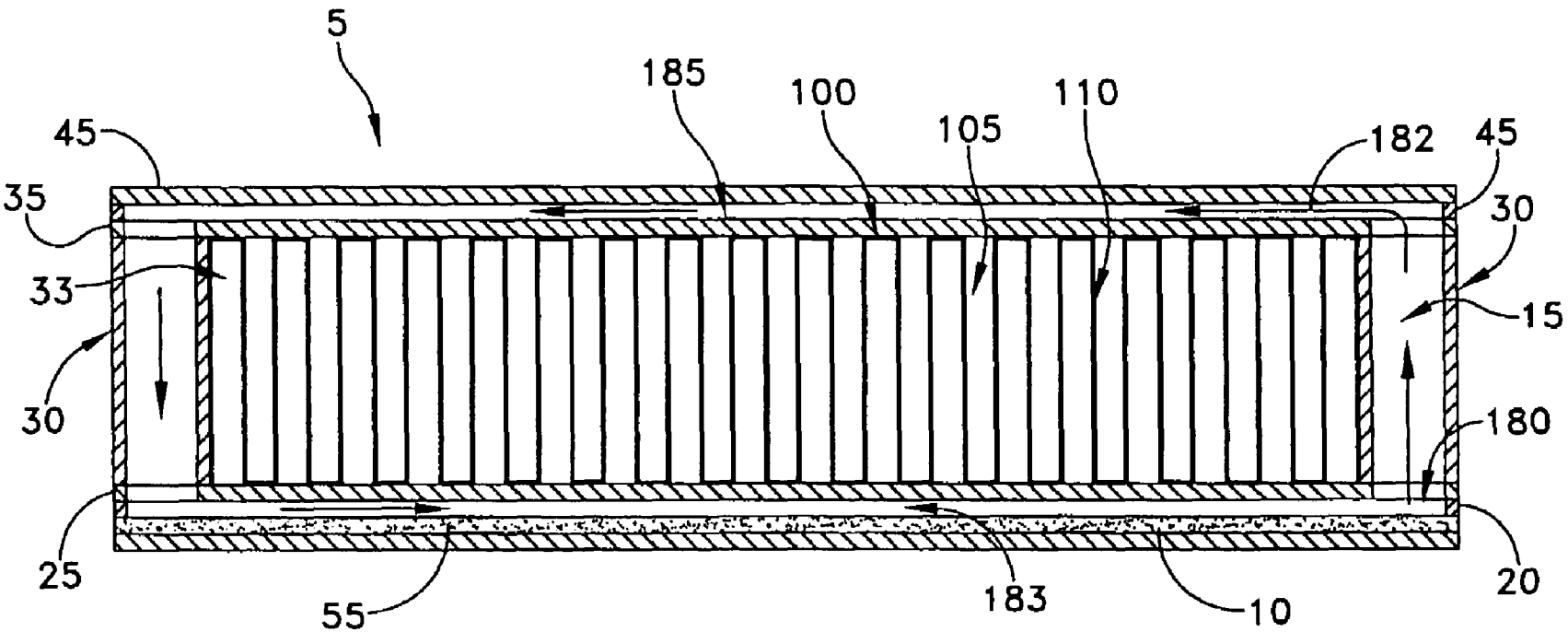
FIG. 3 is a cross-sectional view of a modular heat sink, as taken along lines 3-3 in FIG. 1.

Referring to FIGS. 1-3, a modular heat sink 1 formed according to one embodiment of the invention provides a single module 5 that includes a base plate 10, a first spacer 20, a first separator plate 25, two conduits 30, a folded fin core 33, a second separator plate 35, a second spacer 40, and a top plate 45. Base plate 10 includes an inner surface 47, and is often formed as a rectangular sheet of thermally conductive material, such as copper, molybdenum, aluminum, or the like metal alloys, or thermally conductive composite structures. Inner surface 47 is often coated with a wick 55, such as a sintered or brazed porous metal, screen, or felt layer of the type known in the art. When a module 5 is fully assembled, a working fluid saturates wick 55. The working fluid may be selected from any of the well know two phase vaporizable liquids, e.g., water, alcohol, freon, methanol, acetone, fluorocarbons or other hydrocarbons, etc.

First spacer 20 comprises a thermally conductive frame formed from a pair of spaced-apart lateral rails 60 and a pair of spaced-apart longitudinal rails 65 that together define a central opening 67. First spacer 20 often has a rectangular shape that complements base 10. Lateral rails 60 and longitudinal rails 65 have a similar width and thickness. First separator plate 25 comprises a sheet of thermally conductive material having a central surface 69 located between spaced-apart lateral openings 70 that are defined adjacent to the lateral side edges of the sheet. Each opening 70 is defined by a lateral rail 75 and spaced-apart longitudinal rails 80 that together define an elongate opening. The size and shape of first separator plate 25 is substantially the same as the size and shape of first spacer 20.

Conduits 30 each comprise an open ended tube, often having an ellipsoidal or rectangular cross-sectional shape, with an outer surface 35. Each conduit 30 is formed from a thermally conductive material, such as copper, molybdenum, aluminum, or the like metal alloys, or thermally conductive composite structures, and has a shape and size that is substantially the same as the shape and size of lateral openings 70 of first separator plate 25.

Folded fin core 33 may be formed from a continuous sheet of thermally conductive material, that has been folded into alternating flat ridges 100 and troughs 105. In aggregate, flat ridges 100 combine to define two substantially planar outwardly directed faces 108 at the top and bottom of folded fin core 33. Flat ridges 100 and troughs 105 define spaced fin walls 110, with the end most walls comprising two external side walls 115. Folded fin core 33 also defines two end edges 120 that follow the contour defined by flat ridges 100 and troughs 105.

Second separator plate 35 has a structure similar to that of first separator plate 25. In particular, second separator plate 35 comprises a sheet of thermally conductive material having a central surface 125 located between spaced apart lateral openings 140 defined adjacent to the lateral side edges of the sheet. Each opening 140 is defined by a lateral rail 145 and spaced-apart longitudinal rails 148. The size and shape of second separator plate 35 is substantially the same as the size and shape of first separator plate 25. Second spacer 40 has a structure similar to that of first spacer plate 20. Second spacer 40 comprises a thermally conductive frame formed from a pair of spaced-apart lateral rails 160 and a pair of spaced-apart longitudinal rails 165 that together define a central opening 167. Second spacer 20 often has a rectangular shape that is substantially similar to base 10. Lateral rails 160 and longitudinal rails 165 have a similar width and thickness to one another. When only a single module is to be formed, a top plate 45 is provided that is similar to base 10 in that it is often formed as a rectangular sheet of thermally conductive material, such as copper, molybdenum, aluminum, or like metal alloys or thermally conductive composite structures.

A single module 5 that may form a portion of a modular heat sink 1 is assembled in the following manner. Base 10 is first positioned on a flat surface such that wick 55 is exposed on upwardly facing inner surface 47. Spacer 20 is then circumferentially positioned on a peripheral edge surface of base 10 so as to encircle a preponderance of wick 55. First separator plate 25 is then positioned atop first spacer 20 such that lateral rails 75 and longitudinal rails 80 lie atop corresponding portions of first spacer 20 with central surface 69 facing upwardly. Conduits 30 are positioned within openings 70 of first separator plate 25 so as to project upwardly. Conduits 30, first separator plate 25 and first spacer 20 together define a void space 180 (FIG. 3) separating the lower edge of conduit 30 from the top surface of wick 55 on base 10. With conduits 30 positioned within first separator 25, folded fin core 33 is positioned between conduits 30 so that a bottom face 108 of folded fin core 33 is arranged with the outer surfaces of flat ridges 100 in engaged thermal communication with central surface 69 of first separator 25. In this arrangement, external side walls 115 thermally engage the interior portion of outer surface 35 of each conduit 30. Thus, folded fin core 33 is arranged within module 5 so as to be in thermal conduction communication with first separator plate 25 and conduits 30.

Once folded fin core 33 is secured between conduits 30 and first separator plate 25, second separator plate 35 is positioned on the top face 108 of folded fin core 33. In this position, the top edges of each conduit 30 are positioned within lateral openings 140 of second separator plate 35 and secured in position. Second spacer 40 is then positioned atop second separator plate 35 so that lateral rails 160 and longitudinal rails 165 rest atop lateral rails 145 and longitudinal rails 148 of second separator plate 35, respectively, and with central surface 125 facing upwardly. Top plate 45 is then positioned over second spacer 40 and fastened along a circumferential peripheral edge surface to rails 160, 165 of spacer 40. During the foregoing assembly, each of the individual parts may be fastened to one another by any one of a number of known fixation methods, including welding, brazing, soldering, or through the use of thermal epoxies.

Referring to FIG. 3, upon full assembly of module 5 a closed loop fluid flow path 182 is formed in which an evaporation chamber 183 is defined between base 10 and first separator plate 25 and a condensation chamber 185 is formed between top plate 45 and second separator 35. Evaporation chamber 183 and condensation chamber 185 are arranged in fluid communication with one another via conduits 30. Wick 55 is disposed within evaporation chamber 183, and is saturated with a two-phase working fluid.

In operation, a heat source (not shown) thermally engages an external surface of base 10. The heat generated by the heat source is transferred through base 10 by conduction and thereby vaporizes the working fluid saturating wick 55 within evaporation chamber 183. The working fluid vapor flows through conduits 30 and into condensation chamber 185. At the same time, air flows through folded fin core 33 provides convective heat transfer through spaced fin walls 110, which in-turn cools the corresponding separator plates 25, 35 and conduits 30. The working fluid condenses substantially within condensation chamber 185 and flows back to evaporation chamber 183 so as to resaturate wick 55 on base 10, thus completing a two-phase heat transfer cycle.

Figure 4:
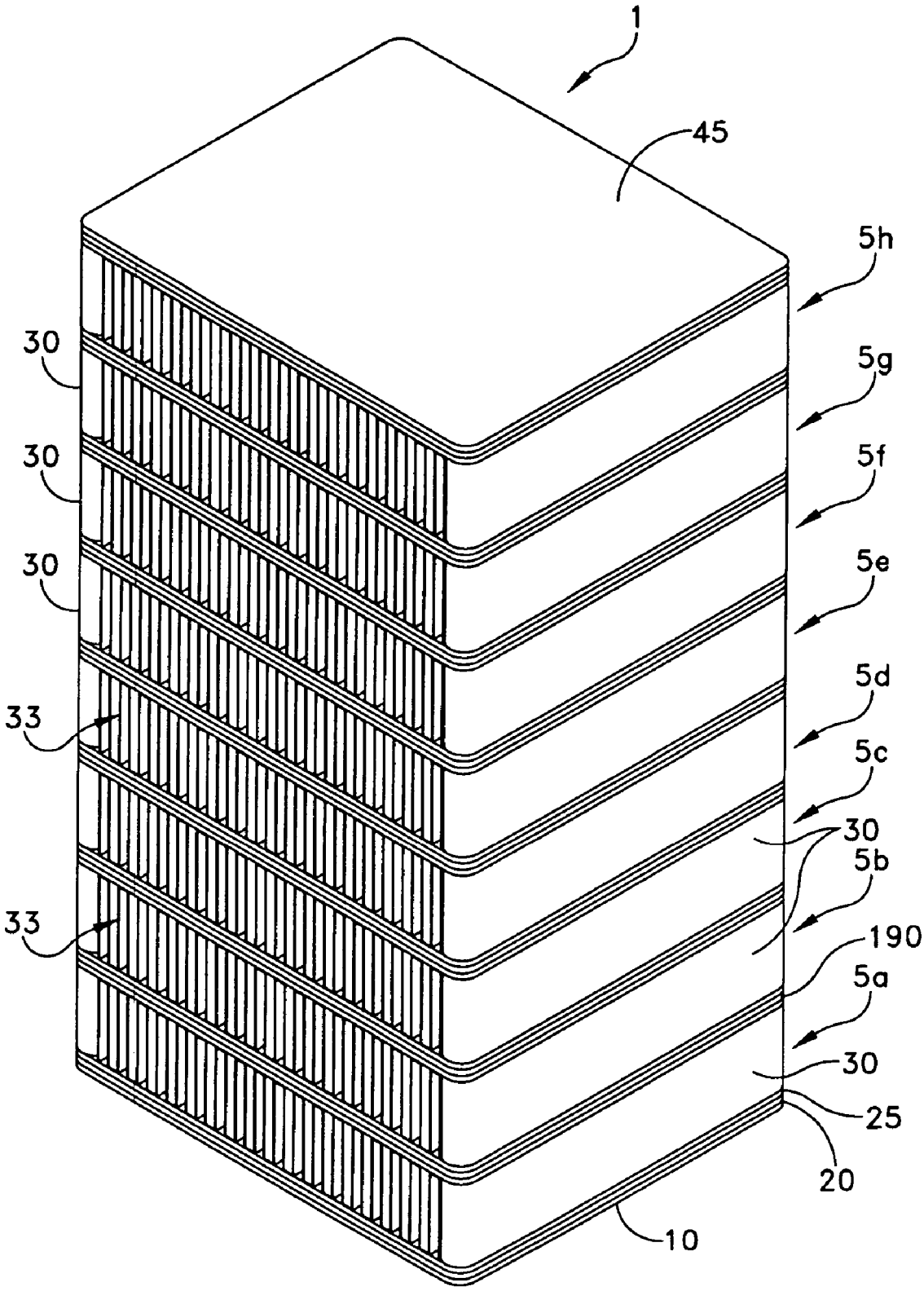
FIG. 4 is a perspective view of an eight module stacked heat sink formed according to one embodiment of the present invention.
Figure 5:
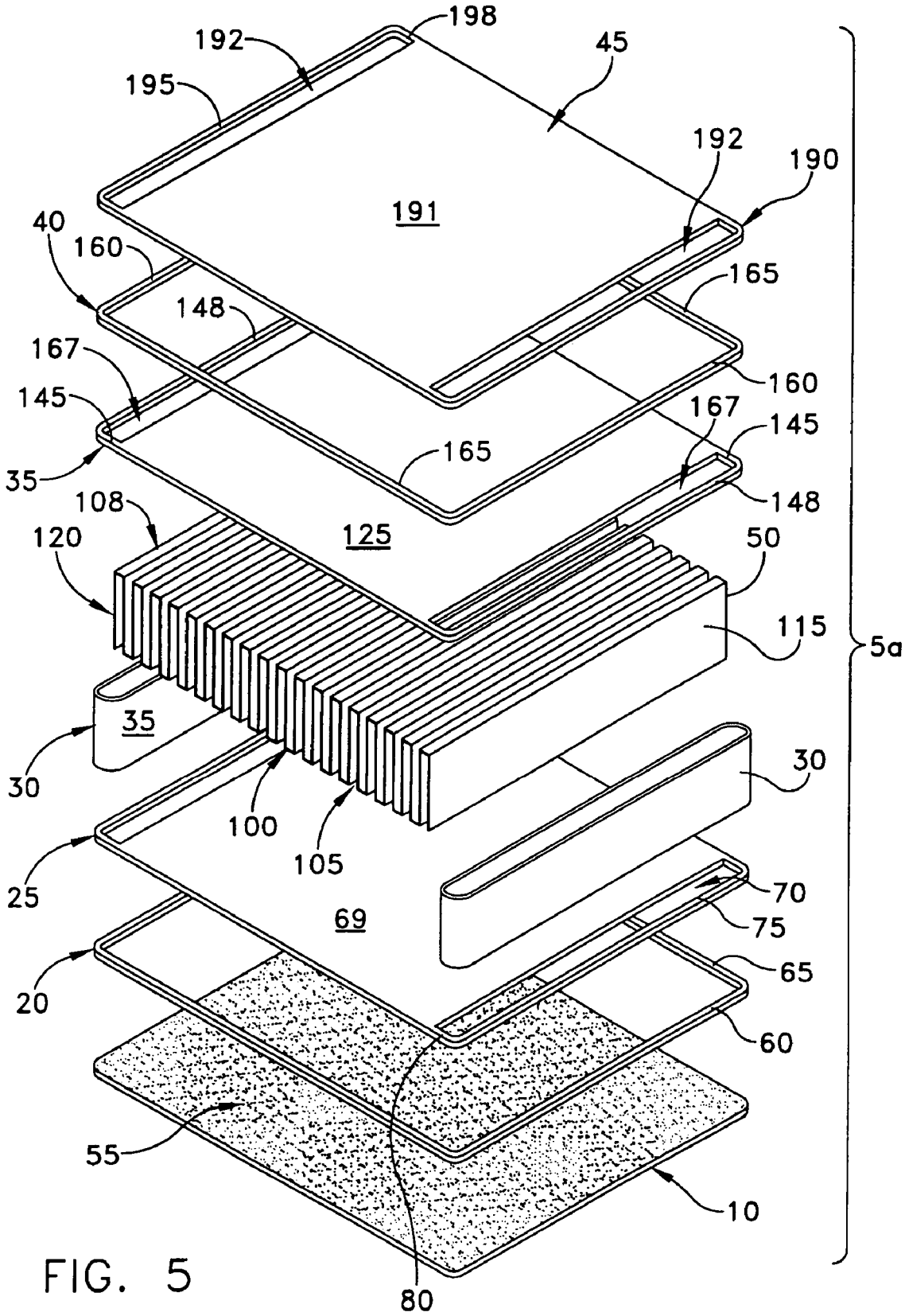
FIG. 5 is an exploded perspective view of a first module of the stacked modular heat sink shown in FIG. 4.
Figure 6:
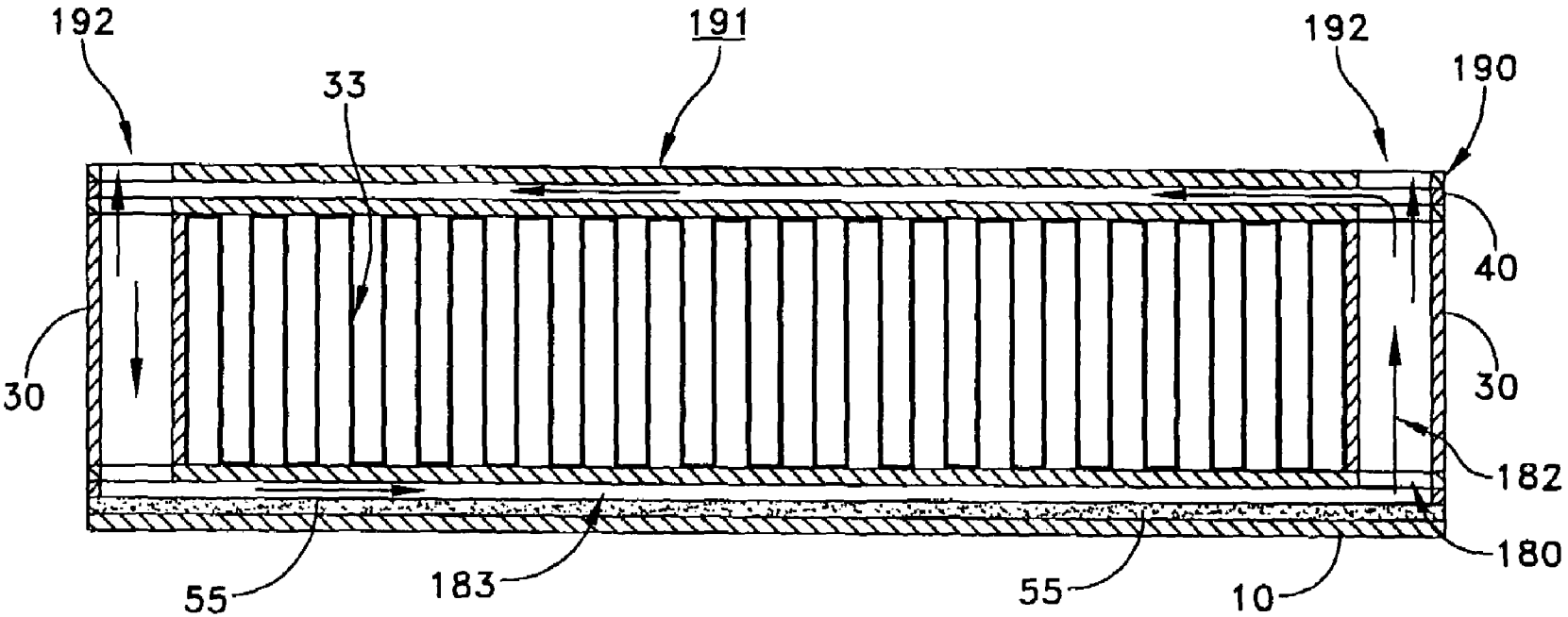
FIG. 6 is a cross-sectional view, similar to that of FIG. 3, of a first module in the stacked modular heat sink shown in FIG. 4.

Depending upon the power requirements of the heat source, multiple cooling modules 5*a-h* may be stacked for optimum efficiency of modular heat sink 1 (FIG. 4). In a multiple module embodiment of the present invention, a third separator plate 190 is positioned atop second spacer 40 (FIG. 5). Third separator plate 190 has a structure similar to that of first and second separator plates 25, 35. In particular, third separator plate 190 comprises a sheet of thermally conductive material having a central surface 191 located between spaced apart lateral openings 192 defined adjacent to the lateral side edges of the sheet. Each opening 192 is defined by a lateral rail 195 and spaced-apart longitudinal rails 198. The size and shape of third separator plate 190 is substantially the same as the size and shape of first and second separator plates 25, 35 (FIG. 5). A third spacer has a structure similar to that of first and second spacers 20, 40.

A second pair of conduits 30 are positioned within openings 192 of third separator plate 190 so as to project upwardly. Second separator plate 35 and third separator plate 190 together define a void condenser space separating lower module 5*a* from upper module 5*b*. With the second pair of conduits 30 positioned within third separator plate 190, a second folded fin core 213 is positioned between second pair of conduits 30 so that its bottom face 108 is arranged with the outer surfaces of flat ridges 100 in thermal communication with central surface 191 of third separator 190. Once again, external side walls 115 thermally engage the interior portion of outer surface 35 of each conduit 30. Thus, the second folded fin core 213 is arranged within second module 5*b* so as to be in thermal conduction communication with third separator plate 190 and second pair of conduits 30. The foregoing assembly may be repeated by adding additional separator plates, conduits, and folded fin cores until a complete stack is formed (FIGS. 4, 5, and 7).

Figure 7:
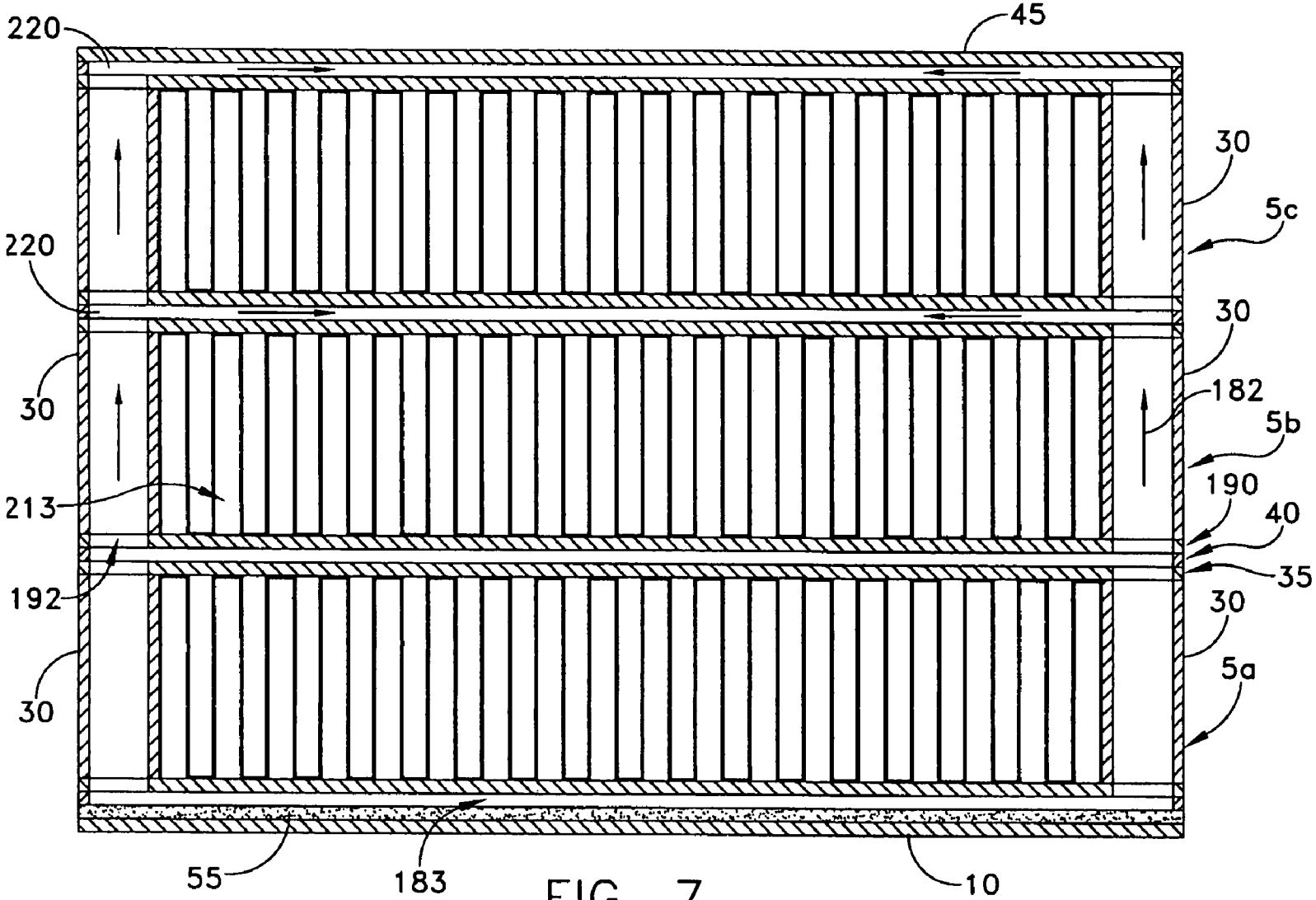
FIG. 7 is a cross-sectional view of a portion of three stack modular heat sink arranged in accordance with an embodiment of the invention.
Figure 8:
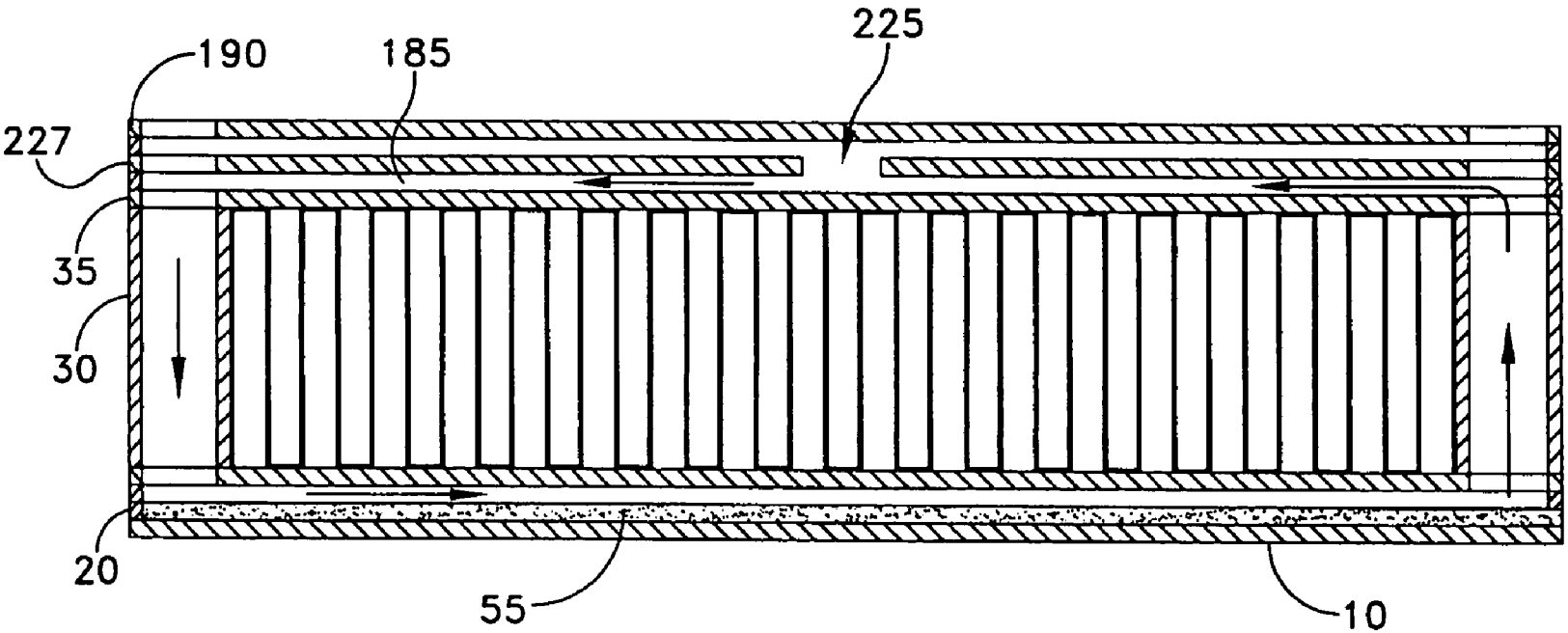
FIG. 8 is a cross-sectional view of another embodiment of a module having a center separator plate.

Referring to FIGS. 4 and 7, upon full assembly of a stacked module closed loop fluid flow path 182 opens through one or more intermediate flow chambers 220 with evaporation chamber 183 being arranged in fluid communication with a plurality of flow chambers 220, via pairs of conduits 30. If additional vapor flow is required, a through opening 225 may be formed in an intermediate separator plate 227 (FIG. 8).

It is to be understood that the present invention is by no means limited only to the particular constructions herein disclosed and shown in the drawings, but also comprises any modifications or equivalents within the scope of the claims.

What is claimed is:

1. A modular heat sink comprising:

an evaporator chamber defined between a base and a first plate, said base having a wick disposed on a surface within said evaporator chamber and spaced away from said first plate, and said first plate defining spaced apart openings that communicate with said evaporator chamber;

a pair of conduits, one positioned within each of said openings, each of said conduits having a passageway arranged in fluid flow communication with said evaporator chamber;

a condenser chamber defined between a second plate and a third plate, said second plate defining spaced apart second openings that communicate with a respective one of said conduits and said third plate disposed in spaced apart confronting relation to said second plate, wherein said first plate and said second plate are spaced apart from one another so as to form a void therebetween; and a folded fin core positioned within said void and between said first plate and said second plate.

2. A modular heat sink according to claim 1 wherein said folded fin is thermally engaged with said first and second plates.

3. A modular heat sink according to claim 1 wherein said folded fin is thermally engaged with said conduits.

4. A modular heat sink according to claim 1 wherein said folded fin is thermally engaged with said first and second plates and said conduits.

5. A modular heat sink according to claim 1 wherein said base and said first plate are separated by a peripherally located spacer comprising a thermally conductive frame formed from a pair of spaced-apart lateral rails and a pair of spaced-apart longitudinal rails that together define a central opening.

6. A modular heat sink according to claim 1 wherein said first plate comprises a sheet of thermally conductive material having a central surface located between spaced-apart lateral openings.

7. A modular heat sink according to claim 6 wherein said openings in said first plate are defined adjacent to lateral side edges of said plate wherein each opening is defined by a lateral rail and spaced-apart longitudinal rails that together define an elongate opening.

8. A modular heat sink according to claim 1 wherein said pair of conduits each comprise an open ended tube.

9. A modular heat sink according to claim 1 wherein said pair of conduits each comprise an open ended tube formed from a thermally conductive material selected from the group consisting of copper, molybdenum, or aluminum and have a shape and size that is substantially the same as the shape and size of said openings.

10. A modular heat sink according to claim 1 wherein said folded fin core comprises alternating flat ridges and troughs.

11. A modular heat sink according to claim 10 wherein said flat ridges and troughs combine to define two substantially planar outwardly directed faces at a top and bottom of said folded fin core.

12. A modular heat sink according to claim 1 wherein said second plate comprises a sheet of thermally conductive material having a central surface located between spaced-apart lateral openings.

13. A modular heat sink according to claim 12 wherein said openings in said second plate are defined adjacent to lateral side edges of said plate wherein each opening is defined by a lateral rail and spaced-apart longitudinal rails that together define an elongate opening.

14. A modular heat sink according to claim 12 wherein a second spacer comprising a thermally conductive frame formed from a pair of spaced-apart lateral rails and a pair of spaced-apart longitudinal rails that together define a central opening is peripherally located on said second plate.

15. A modular heat sink according to claim 14 wherein a top plate is positioned upon said second spacer so as to form a complete module.

16. A modular heat sink including at least two modules comprising:

an evaporator chamber defined between a base and a first plate, said base having a wick disposed on a surface within said evaporator chamber spaced away from said first plate and partially saturated with a two-phase fluid, wherein said first plate defines laterally spaced apart openings that communicate with said evaporator chamber;

a first pair of conduits, one positioned within each of said openings, each of said first conduits having a passageway arranged in fluid flow communication with said evaporation chamber;

a first condenser defined between a second plate and a third plate, said second plate defining spaced apart second openings that communicate with a respective one of said conduits and said third plate disposed in spaced apart confronting relation to said second plate, said third plate defining laterally spaced apart openings that communicate with said first condenser chamber and said first conduits, wherein said first plate and said second plate are spaced apart from one another so as to form a first void therebetween;

a first folded fin core positioned within said first void and between said first plate and said second plate; and a second pair of conduits, one positioned within each of said second openings, each of said second conduits having a passageway arranged in fluid flow communication with said first condenser chamber and said first conduits;

a second condenser chamber defined between said third plate and a fourth plate, said third plate defining spaced apart third openings that communicate with a respective one of said second conduits and said fourth plate disposed in spaced apart confronting relation to said third plate, said fourth plate defining laterally spaced apart openings that communicate with said first condenser chamber and said first and second conduits, wherein said third plate and said fourth plate are spaced apart from one another so as to form a second void therebetween; and a second folded fin core positioned within said second void and between said third plate and said fourth plate.

17. A modular heat sink according to claim 16 wherein said first folded fin is thermally engaged with said first and second plates and said second folded fin core is thermally engaged with said third and fourth plates.

18. A modular heat sink according to claim 16 wherein said first folded fin is thermally engaged with said first conduits and said second folded fin core is thermally engaged with said second conduits.

19. A modular heat sink according to claim 16 wherein said first folded fin is thermally engaged with said first and second plates and said first conduits, and said second folded fin core is thermally engaged with said third and fourth plates and said second conduits.

20. A modular heat sink according to claim 16 wherein said conduits and said chambers define a closed loop fluid flow path.

* * * * *